United States Patent [19]

Naab et al.

[11] Patent Number: 4,824,315

[45] Date of Patent: Apr. 25, 1989

[54] EQUIPMENT FOR EMPTYING CONTAINERS STATEMENT AS TO RIGHTS TO INVENTIONS MADE UNDER FEDERALLY-SPONSORED RESEARCH AND DEVELOPMENT

[75] Inventors: Jakob Naab, Mainz; Karl-Heinz Dröge, Löhne; Hans-Joachim Pieperhoff, Zornheim, all of Fed. Rep. of Germany

[73] Assignee: Zoller-Kipper GmbH, Mainz-Laubenheim, Fed. Rep. of Germany

[21] Appl. No.: 75,733

[22] Filed: Jul. 20, 1987

[30] Foreign Application Priority Data

Jul. 21, 1986 [DE] Fed. Rep. of Germany ..... 3624590

[51] Int. Cl.[4] ..... B65F 3/02

[52] U.S. Cl. ..... 414/408; 414/409; 414/21; 414/422; 414/421; 414/917; 177/141; 177/147

[58] Field of Search ..... 414/21, 406, 407, 408, 414/409, 410, 419, 420, 421, 422, 423, 424, 540, 546, 555, 917; 177/151, 152, 153, 3, 256, 141, 147

[56] References Cited

U.S. PATENT DOCUMENTS

| | | | |
|---|---|---|---|
| 2,635,868 | 4/1953 | Reid et al. | 177/141 X |
| 2,877,906 | 3/1959 | Coash et al. | 177/141 X |
| 2,926,796 | 3/1960 | Martinson | 177/141 X |
| 3,244,243 | 4/1966 | Fielder | 177/147 X |
| 3,371,526 | 3/1968 | Futhauer | 414/21 X |
| 3,908,772 | 9/1975 | Bohlin et al. | 177/147 X |
| 4,677,579 | 6/1987 | Radomilovich | 177/147 X |
| 4,722,656 | 2/1988 | Naab | 414/21 X |

FOREIGN PATENT DOCUMENTS

| | | | |
|---|---|---|---|
| 3332058 | 9/1983 | Fed. Rep. of Germany . | |
| 3447648 | 12/1984 | Fed. Rep. of Germany . | |
| WO82/02024 | 6/1982 | World Int. Prop. O. | 177/136 |

*Primary Examiner*—Frank E. Werner

*Attorney, Agent, or Firm*—H. Gibner Lehmann; K. Gibner Lehmann

[57] ABSTRACT

An emptying utility for containers, in particular for emptying garbage containers into the collecting tank of a garbage truck, is equipped with a weighing device which determines during the uninterrupted progress of the emptying operation, in one or two time clock windows, the weight of the filled container moving upwardly and, possibly, the weight of the emptied container moving downwardly. Towards this end there is provided a force transducer at that element of the pour-in utility which is connected to the fixed support of the utility, either directly or via an intermediate member. Display and/or registering instruments of the utility contain a control and computing unit which is capable of selecting predetermined measured values, for use in evaluation, from all those measured values which are constantly being supplied by the force transducer during the entire, uninterrupted course of the emptying operation. The selecting of the measured values for evaluation is effected during one or several time clock windows.

18 Claims, 7 Drawing Sheets

Fig.9
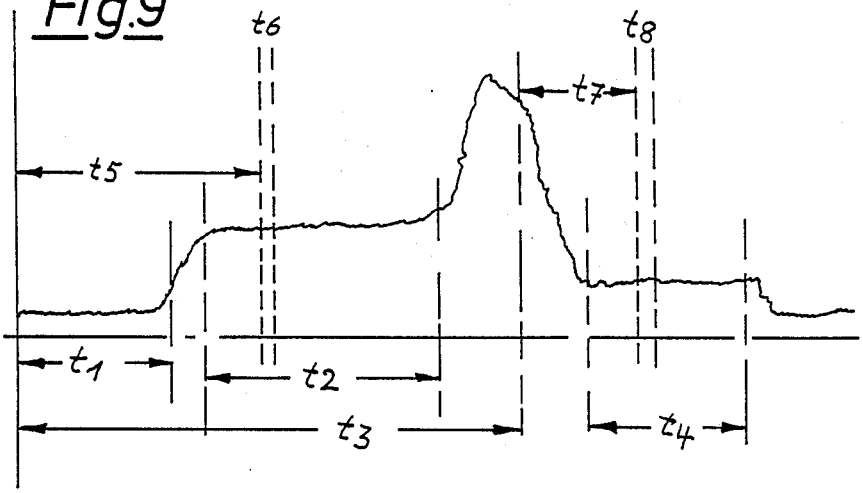
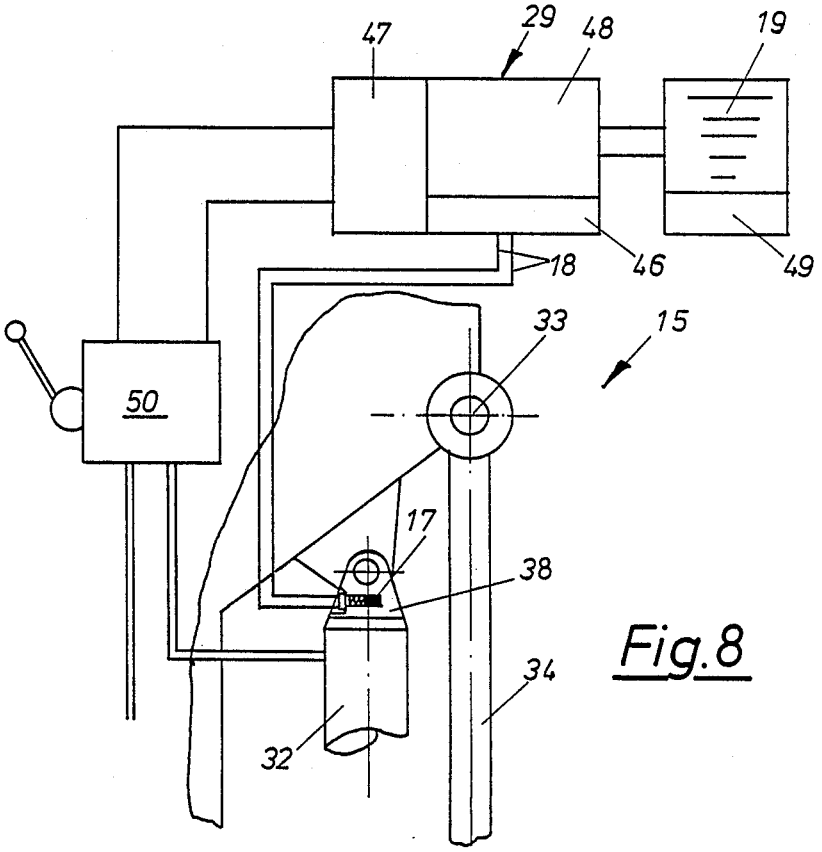
Fig.8

EQUIPMENT FOR EMPTYING CONTAINERS

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates to equipment for emptying containers, and more particularly to vehicle-carried equipment for emptying garbage containers into the collection tank of a garbage truck.

2. Description of the Related Art Including Information Disclosed under 37 CRF §1.97–1.99

Prior garbage trucks adapted for facilitating the handling of heavy, filled containers have a pour-in utility or device which is provided with lifting/tilting functions that include a tilting mechanism which is mounted, directly or via intermediate members on a fixed support or framework that is located at the pour-in opening or pour-in rim. The pour-in utility has coupling means or fittings engageable with the containers to be emptied, as well as powered drive members connected to said fittings and supported directly or via the intermediate members on the fixed support. Such pour-in utilities further include force transducers of a container-weighing device which is equipped with display and/or registering instruments.

A prior utility of this type, disclosed in German Patent Application Publication No. 33 32 058 is equipped with a weighing device which is included in the lifting-/tilting or tilting mechanism and with which the garbage containers can be weighed prior to and also after the emptying. The weighing result, together with the simultaneous, automatic identification of each container, is to be utilized for the determination of how much container content weight has been emptied from the container so as to be able, in the example of garbage removal, to calculate the fees that are payable by the amount of weight of the garbage to be transported away.

In the garbage can emptying device disclosed in German Patent Application Publication No. 34 47 648 a weighing device is installed in the coupling means or fittings located at the lifting/tilting or tilting mechanism. In this known device, too, the weighing of the container to be emptied and the weighing of the emptied container can be accomplished only in the raised, at rest position.

However, the necessary stopping of the lifting motion and the lowering motion of the container, heretofore essential for the weighing operation, entails the drawback that a quite considerable time loss must be tolerated in the emptying operation on the one hand, while on the other hand the stopping of the lifting or lowering motion and the restarting of the lifting or lowering motion can cause the containers to experience considerable vibrations, these also being experienced by the emptying mechanism. Such vibrations effect a more rapid, undesirable wear. In addition, the stopping and restarting motions also increase considerably the energy requirements for the emptying operation.

SUMMARY OF THE INVENTION

Therefore, it is an object of the present invention to improve substantially the utility for emptying containers, in which a weighing device is included, by enabling the utility to carry out a "dynamic weighing" instead of the known weighing in a position at rest, thereby obviating the stopping and restarting motions during the emptying operation with the disadvantages and drawbacks associated therewith. At the same time, the emptying utility is improved with respect to its operating safety, malfunction resistivity, simple design and easy operation of the weighing means.

According to the invention, these problems are solved in that the force transducer of the weighing means is mounted on a pour-in utility element which is connected, directly or via an intermediate member, to the fixed support for the pour-in utility and in that the display and/or registering instruments contain a control and computing unit which is designed or settable to select the required data from only certain measured values of all the values that are constantly being supplied by the force transducer during the entire uninterrupted emptying cycle. The selected measured values occur during certain time intervals and are selected as those suitable to be utilized for the evaluation.

What the invention achieves is that the operation and motions of the pour-in utility are fluid, that is, of fluid-like nature during the emptying process. The force transducer can remain turned on during the entire motion cycle. The necessity, which is required in a device according to German Patent Application Publication No. 34 47 648, of having to unlock the force transducer prior to the weighing operation and then to relock it after the weighing operation, is obviated, as is also obviated the danger of possibly damaging the force transducer if it is not relocked after the weighing operation.

It has been shown that the possibility of a fluid-like pour-in utility operation exists only if the force transducer is mounted in a place that is protected from vibrations to a great extent. According to the present invention, this is accomplished in that the force transducer of the weighing means is mounted on an element that is connected to the fixed support of the pour-in utility either directly or via a stationarily or fixedly mounted intermediate member. In this way it is achieved that the vibration component absorbed by the force transducer is small enough to be able to utilize it for the evaluation of the measured value or signal transmitted by the force transducer in a control and computing unit provided in the display and/or registering instrument. In addition, the invention is based on the knowledge that the vibrations occurring in an emptying device according to the invention have amplitudes which vary in time so that there are time periods which are favorable for the weighing operation in the course of the emptying process. According to the invention therefore, the measured values constantly coming from the force transducer are evaluated in the control and computing unit only within these periods of time which are favorable for the weighing process, while being neglected at other times. These time periods which are favorable for the weighing process can differ from one emptying utility to another emptying utility. But they can be set in a simple manner by appropriately adapting the control and computing unit.

In a particularly advantageous embodiment of the invention, the control and computing unit is designed for the selection of measured values within a set or settable time span, starting with the reception of a control signal, and for this purpose it is connected to a signal transmitter that is inserted in the control unit of the pour-in utility and that emits a control signal in the initial stage of the emptying process. This signal transmitter can be started with that particular actuation of the control unit of the pour-in utility or device which is required for the initiation of an emptying process and the transmitter can emit, via a possibly adjustable timer, a control signal to energize the control and computing unit as soon as the time span in the initial stage of the emptying process, which is favorable for the weighing operation, has been reached. This fixes unequivocally and reproducibly the measuring moment or measuring time span for the weighing operation. The length of the measuring time span can be set or settable at the signal transmitter, or also at the control and computing unit itself. One thereby obtains a time clock window which guarantees the utilization of the most effective and most favorable time span for the weighing operation within the emptying process, and within which the evaluation of the weighing process takes place.

If it is intended to weigh the emptied container also, a second such time clock window can be arranged by connecting the control and computing unit to a signal transmitter which, in addition to the above described first emission of a control signal, also emits another control signal in the initial stage of the return motion of the emptied container. Another possibility for the generation of the two time clock windows within the scope of the invention is to connect the control and computing unit to two signal transmitters, one of which responds in the initial stage of the emptying process and the second of which responds in the initial stage of the return motion of the emptied container.

In addition to the creation of such a time clock window it is further possible within the scope of the invention to reduce considerably the disadvantageous effect of vibrations by having the control and computing unit contain a low-pass filter for the measured values supplied by the force transducer. It presents no problem to calculate and design such a low-pass filter on the basis of the vibratory characteristics of the lifting/tilting or tilting mechanism and its components and on the basis of the desired vibration attenuation.

Another possibility of reducing the vibrations and their consequent disadvantages for the weighing process is to provide, in the path of power transmission between the lifting/tilting or tilting mechanism and the fixed support where the force transducer is located, additional damping and buffering elements. Finally, an additional force transducer for the weighing means can also be mounted on another element or on the same element of the lifting/tilting or tilting mechanism but at another point in the power transmission path, with all of the force transducers connected to a computer which is provided in the display and/or registering unit and which is designed to compare the measured values supplied to it simultaneously. Since the force transducers installed in various elements or at different points on one element basically furnish identical measured values superposed, however, by vibration components greatly varying from each other, the vibration components superposing the actual measured values can be eliminated by such a comparing computer.

In an advantageous further development and improvement of the invention, falsifications of the measuring results brought about by the tilted position of the pour-in utility are also eliminated, whereas falsification of the measuring results due to shifting of the center of gravity of the container to be emptied have turned out to be insignificant. In garbage trucks, such a variation of the inclined position of the pour-in utility can occur because the vehicle lowers itself more at its rear axle springing, as the collecting truck becomes more and more loaded. The tilted position of the pour-in utility will change even more when a garbage truck stands in a downhill street. If, in one or another application, such a falsification of the measuring results due to variation in the tilted position of the pour-in utility must be eliminated, it is recommended within the scope of the invention to design the control and computing unit for the correction of the measured values on the basis of changes in the inclined position of the pour-in utility, and to connect it for this purpose to means adapted to measure the momentary inclined position.

In a preferred embodiment of the invention in which the drive mechanism contains a pressure medium operated cylinder/piston arrangement supported unilaterally by the stationary or fixed support, either directly or via a fixed intermediate member, the force transducer is mounted, according to the invention, in the area of a mounting lug of the cylinder/piston arrangement, preferably the mounting lug facing or movable with respect to the fixed support. But it is also possible to mount one each force transducer for the weighing means in the area or vicinity of both mounting lugs of the cylinder/piston arrangement. In such an embodiment of the invention, each force transducer is inserted in a hole provided for this purpose in the cylinder end and/or piston rod end which forms or carries the respective mounting lug.

In this latter embodiment of the invention, the force transducer can also be mounted on the support element for the cylinder/piston arrangement which forms a mounting lug and is attached to the fixed support or to a fixed intermediate member, such as being inserted in a hole drilled into the support element for this purpose. It is of particular advantage in such an embodiment of the invention to tailor the time clock window which is provided for the evaluation or summation of the measured values supplied by the force transducer, to the direction of action of the cylinder/piston arrangement. To accomplish this, the display and/or registering instruments can, according to the invention, contain a time-controlled control and computing unit which releases for evaluation only those particular measured values which come from the force transducer in designated time periods during which the cylinder/piston arrangement exerts on the container a virtually vertically-oriented lifting force. This vertically oriented lifting force can be exerted, on the one hand, to lift the container and, on the other hand, to support the lowering motion of the container, i.e. during the lifting operation and also during the lowering operation.

In yet another embodiment of the invention, in which the lifting/tilting or tilting mechanism contains a pivot shaft mounted on the stationary or fixed support either directly or via a fixed intermediate member (intermediate frame), there can be provided, according to the invention, at the mountings of the pivot shaft, a force transducer which measures the vertical component of the load transmitted from the pivot shaft to the fixed support, said force transducer being preferably inserted in a hole drilled for this purpose into these pivot-shaft mountings.

In still another embodiment of the invention in which the pour-in utility has an intermediate frame serving as an intermediate member for mounting it with a limited vertical mobility on structural parts of a collecting tank such as of a garbage truck forming the fixed support, this intermediate frame can be mounted on force transducers that rest on the structural collecting tank parts. In this embodiment of the invention, the load transmitted from the intermediate frame to the structural collecting tank parts is measured, and the container weight is the difference between this momentarily-transmitted load and the basic load that is generated by the pour-in utility. There can be a certain drawback when the basic load measured in each case is greater than the said difference, corresponding to the container weight, between the momentary load and the basic load. On the other hand, it is an advantage of this embodiment of the invention that the force transducer signals thus obtained are virtually free of interfering vibration components, and that the influence of interfering vibration components can be eliminated with particular ease and efficiency. For instance, the intermediate frame in this specific embodiment of the invention can be mounted via rubber-metal elements on the structural collecting tank parts forming the fixed support. It is also possible to mount the intermediate frame via forked levers onto the structural collecting tank parts forming the fixed support; it further being advantageous in regard to this possibility to add to the forked levers mechanical damping and buffering elements which are active between the intermediate frame and the structural collecting tank parts. Since in this described embodiment of the invention virtually the entire weight of the pour-in utility rests on the force transducers, it is recommended that care be taken to insure that the force transducers are relieved of the weight of the pour-in utility during those time spans in which no containers are being emptied. Such time spans are, for example, transport times in which a garbage truck is driven to the collection site, or after having been completely loaded, from the collection site to the dump site and back. Especially when driving garbage trucks, such a relief seems important to prevent shocks from being exerted on the force transducers. Such a safety relief can be accomplished within the scope of the invention in that the intermediate frame can be locked by a locking mechanism to the structural collecting tank parts forming the fixed support in a position in which the force transducers are relieved of the weight of the pour-in utility. This locking mechanism can be operable either mechanically, hydraulically, pneumatically or electromechanically.

Other features and advantages will hereinafter appear.

Embodiment examples of the invention are described below in greater detail with reference to the drawings, in which:

FIG. 8 is a block diagram of the utility according to the invention, and

FIG. 9 is a measured-value graph produced by the force transducer, freed of vibration components by means of a low-pass filter, in a pour-in utility according to FIG. 4.

Figure 1:
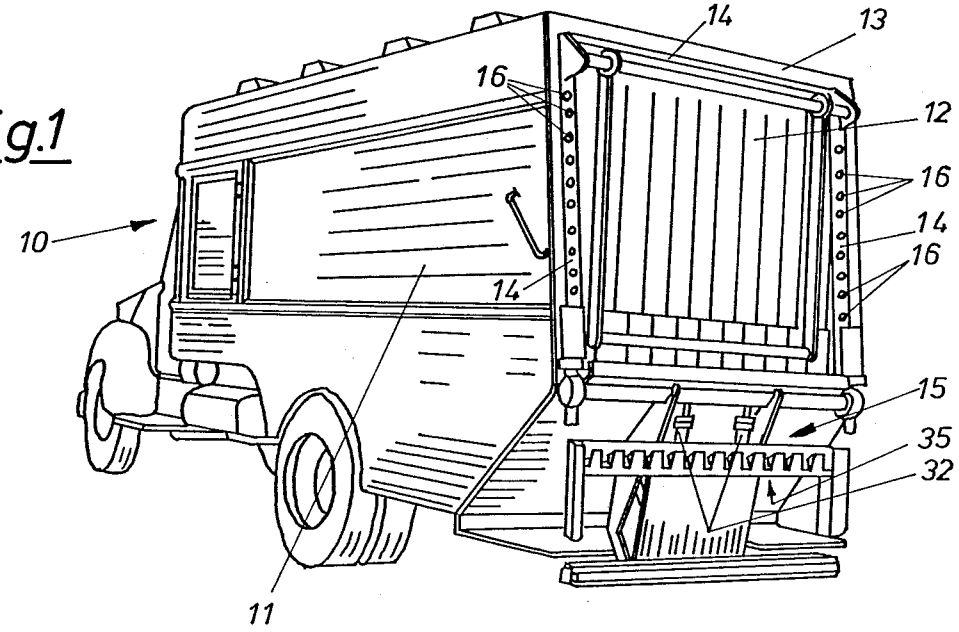
FIG. 1 is a rear perspective view of a garbage truck equipped with an emptying utility in accordance with the invention.

In the example of FIG. 1, a garbage truck 10 is equipped with a stationary or fixed collecting tank 11. Formed at the rear fixed wall 13 of the collecting tank 11 is a pour-in opening 12 surrounded by an intermediate frame 14. The wall 13 is herein also termed a "fixed support". The intermediate frame 14 supports the pour-in emptying utility 15 which, in this example, has a lifting/tilting mechanism. In this case, the utility 15 is equipped with a lifting/tilting frame 35 which has at its upper part a support beam that extends transversely across the width of the pour-in opening 12 and serves the hooking function for the garbage pails to be emptied. The frame 35 can be raised into an upper raised position by means of cylinder/piston units.

Figure 2:
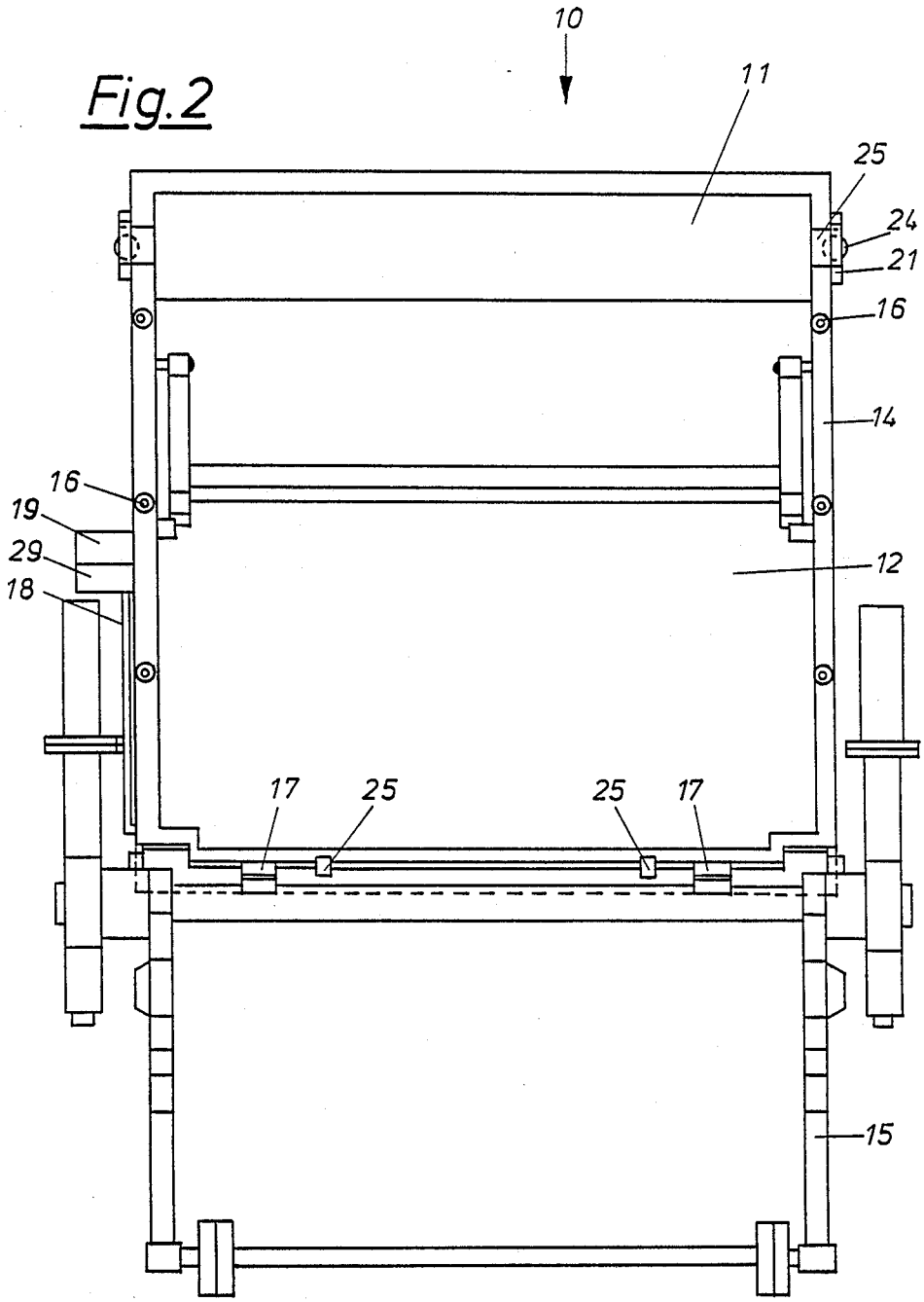
FIG. 2 is a rear elevational view of a tilting mechanism mounted on an intermediate frame carried by a garbage truck and constituting a modified embodiment of the invention.

The intermediate frame 14 is mounted on the rear wall 13 of the collecting tank 11 by means of rubber-metal elements 16 so as to have limited vertical mobility, and at its lower edge the tank 11 rests on force transducers not here shown (they can be seen clearly in FIG. 2).

FIG. 2 shows the rear of the garbage truck 10 with a modified pour-in utility 15. In this example also, the pour-in opening 12 of the collecting tank 11 is surrounded by an intermediate frame 14. And the intermediate frame 14 supports the pour-in utility 15 and is joined to the collecting tank 11 by rubber-metal elements 16. In its lower end position the intermediate frame 14 rests on force transducers 17 which are permanently mounted on the rear wall 13 (fixed support) below the lower edge of the intermediate frame 14. The force transducers 17 are connected by electrical lines 18 to an indicating instrument 19 which contains a control and computing unit 29 to transmit the measured values coming from the force transducers 17 to the indicating instrument 19 and to a registering instrument connected thereto. These devices are calibrated so that the measured values coming from the force transducers 17 are displayed and registered in selected weight units. As explained in connection with FIG. 8, the indicating instrument 19 can contain an electric low-pass filter which eliminates the electrical oscillations that are present in the measured values of the force transducers 17 due to mechanical vibrations at the intermediate frame 14, thereby excluding or at least considerably reducing errors in the display or registration of weight.

Figure 3:
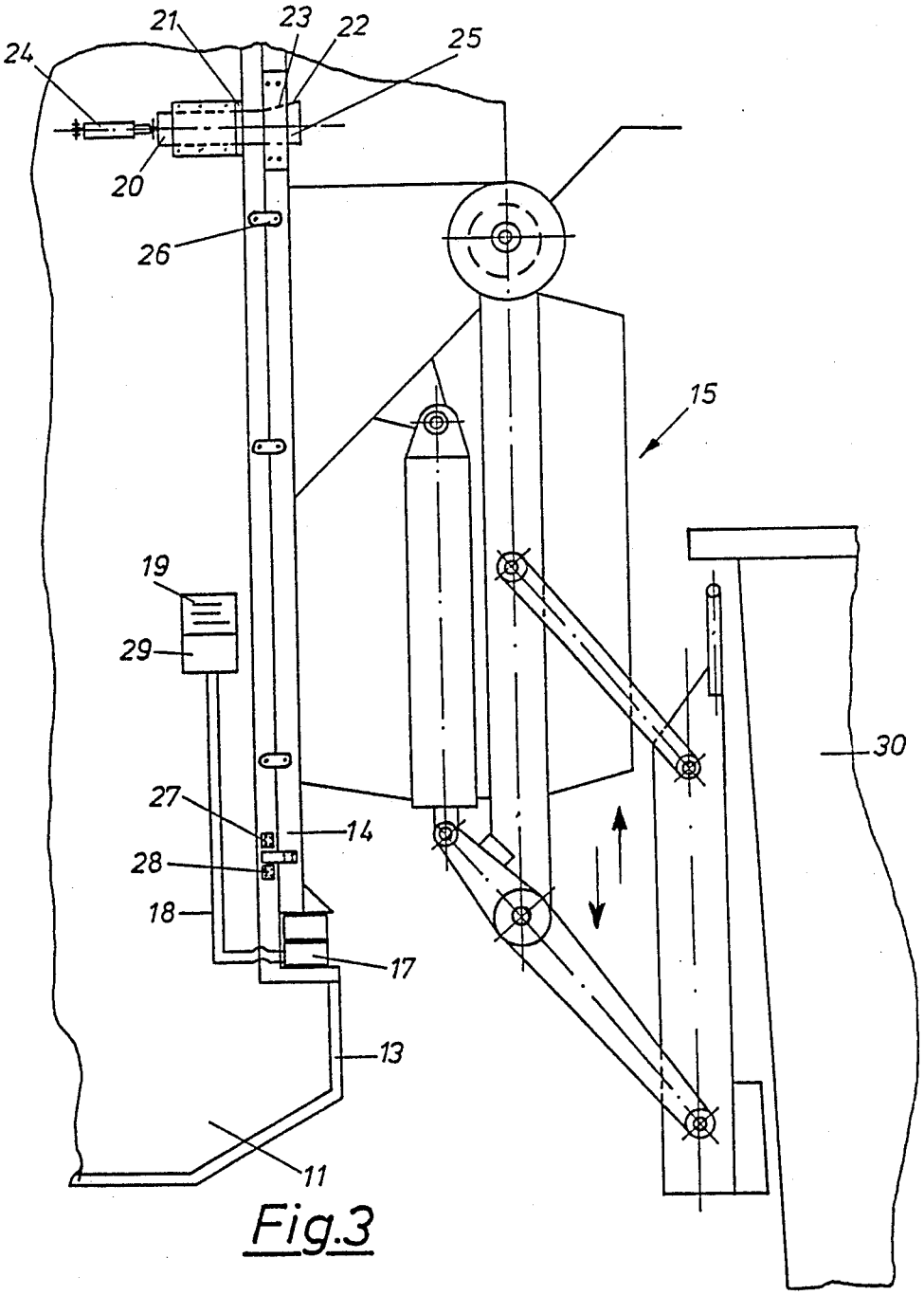
FIG. 3 is a side elevational view of a third embodiment of emptying utility in accordance with the invention, with a lifting/tilting mechanism mounted on an intermediate frame and with the collecting tank shown broken away.

In the example of FIGS. 1 to 3, the force transducers 17 are arranged so that the increased load occurring at the intermediate frame 14 due to the lifting of the container is transformed into a measured value signal for the corresponding container weight and is displayed.

In this context it is important that only the force acting vertically enter the force transducers 17. It is for this reason that, in the examples according to FIGS. 1 to 3 the intermediate frame 14, floatingly mounted on the collecting tank 11 by guide plates 20, is held on the collecting tank 11 in a manner so as to be able to have essentially vertical motions only. The guide plates 20, in turn, are mounted on the collecting tank 11 in ways 21, with a bevel 22 engaging a converging surface 23 of the intermediate frame 14.

The intermediate frame 14 can be raised by lift applied by surfaces 22, 23 powered from a drive 24, thereby to relieve stress on the force transducers 17, during the general driving operation of the garbage truck 10. At the same time, the intermediate frame 14 is locked to the collecting tank 11 by means of the guide plate 20, areas or portions of which are designed as a locking mechanism.

According to FIG. 3, the connection of the intermediate frame 14 to the collecting tank 11 via rubber-metal elements is replaced by forked levers 26. In this case there are advantageously provided in addition to the guide plates 20, upper stops 27 and lower stops 28 which give the intermediate frame 14 greater mobility in vertical directions than the rubber-metal elements. The stops 27 and 28 become effective particularly if the locking of the intermediate frame 14 by means of the guide plates 20 fails due to malfunction or is not actuated when the distances between the various emptying sites are short.

Since the sensing distance of the force transducers 17 amounts to only fractions of millimeters, the overall motion of the intermediate frame 14 must be limited accordingly to prevent unnecessary wear in the rough operation of garbage removal.

Also, in the example of FIG. 2, the force transducers 17 are basically relieved of stress by the guide plates 20 provided with the drives 24.

The number of force transducers 17 per truck should be selected in accordance with the kind and size of the respective utility. A single force transducer may be entirely sufficient. Contrary to the example shown it may also be advantageous to design the mounting of the intermediate frame 14 on the collecting tank 11 so that, for example, a lock is released only at the end of the lifting stroke, thereby releasing the intermediate frame 14 for floating movement for a short period of time in order to utilize such short time span in the manner of a time-clock window for determination of the container weight. This process could also be controlled separately and automatically through the lever arrangement of the pour-in utility 15.

Figure 4:
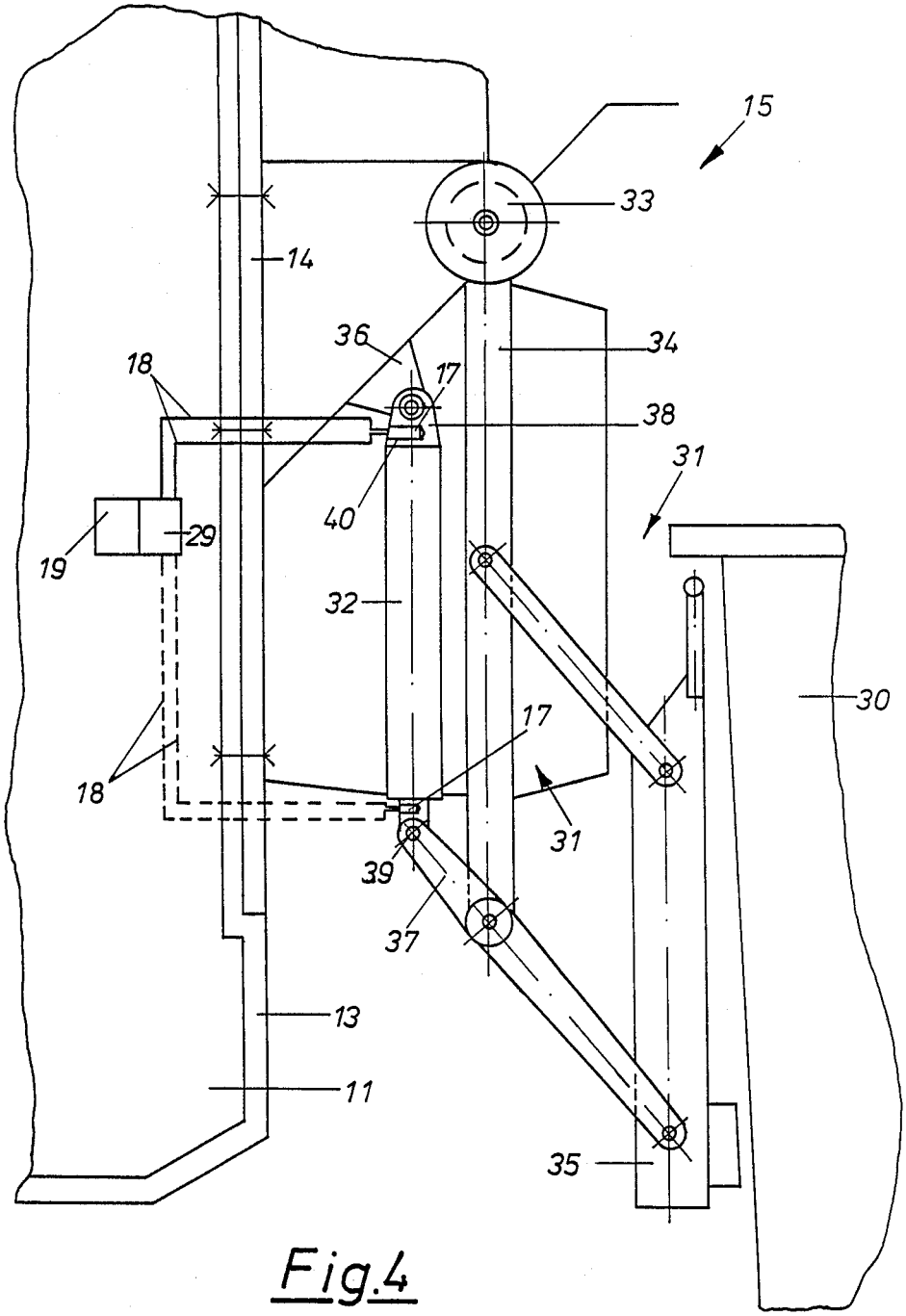
FIG. 4 is a side elevation of the pour-in utility, illustrating a still further modified embodiment of the device according to the invention.
Figure 5:
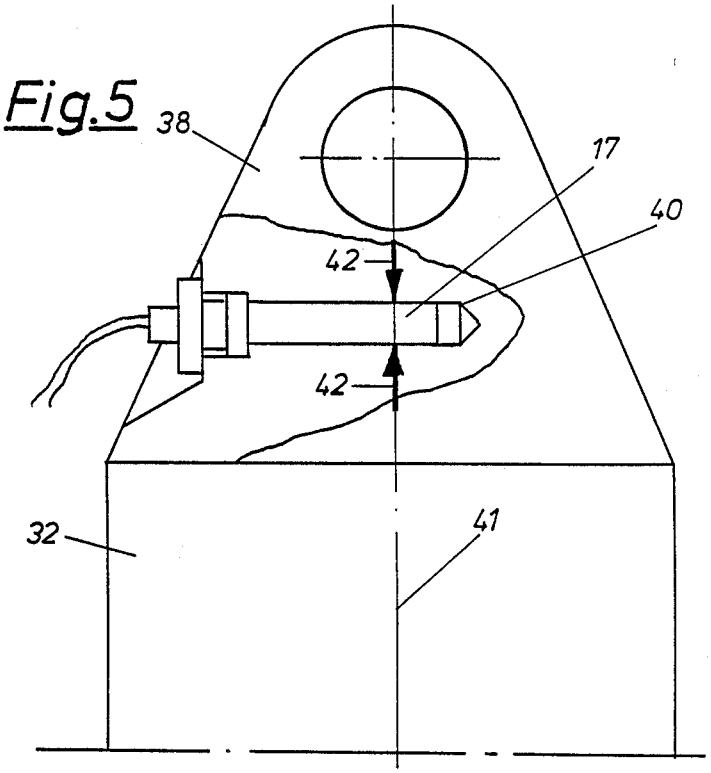
FIG. 5 is a detail of the upper end area of a cylinder/-piston arrangement of the utility according to FIG. 4, in an enlarged view.

In the examples of FIGS. 4 and 5 a pour-in utility 15 with a lifting/tilting mechanism is provided. This lifting/tilting mechanism 31 contains a cylinder/piston unit 32 which furnishes the power for both lifting and tilting. But there could also be provided a cylinder/piston unit for lifting only, and a separate pressure-medium motor for the tilting process.

In the example of FIGS. 4 and 5 there is permanently installed in the rear wall 13 of the collecting tank 11 an intermediate frame 14 supporting the pour-in utility 15. This intermediate frame 14 supports on the one hand the pivot shaft 33 with pivot arms 34 and the lifting/tilting frame 35 attached to the pivot arms 34 by a four-bar mechanism. The cylinder/piston unit 32 provided for the lifting and tilting motion is installed between a mounting lug 36 fixed to the intermediate frame 14 and an actuating arm 37 of the four-bar mechanism, its cylinder lug 38 being linked to the fixed bearing lug 36 and a piston lug 39 being linked to the actuating lever 37.

As FIGS. 4 and 5 show, a hole 40 in which a force transducer 17 is inserted is provided in the cylinder lug 38. This force transducer 17 absorbs the axial force developed by the cylinder/piston unit 32 and generates therefrom a signal which is transmitted through electrical lines 18 to the display and registering instrument 19, or to the latter's control and computing unit 29. As FIG. 5 shows in detail the force transducer 17 in this example is rod-shaped and extends in the hole 40 up to the area of the centerline 41 of the cylinder and the cylinder lug 38.

It is further evident from FIG. 4 that, instead of or in addition to providing the force transducer 17 in the cylinder lug 38, a force transducer 17 can also be provided in the lug 39 of the piston rod. In view of the closer proximity of the cylinder lug 38 to the fixed parts of the device, namely to the intermediate frame 14 and the rear wall 13 in the power transmission path and in view of the greater facility of conducting the electrical lines 18, mounting the force transducer 17 in the cylinder lug 38 is to be preferred.

Whether or not the force transducer 17 is located in the cylinder lug 38 or in the piston rod lug 39, pressure is applied to it in the sense of the arrows 42 shown in FIG. 5 in accordance with the force developed by the cylinder/piston unit 32.

Figure 6:
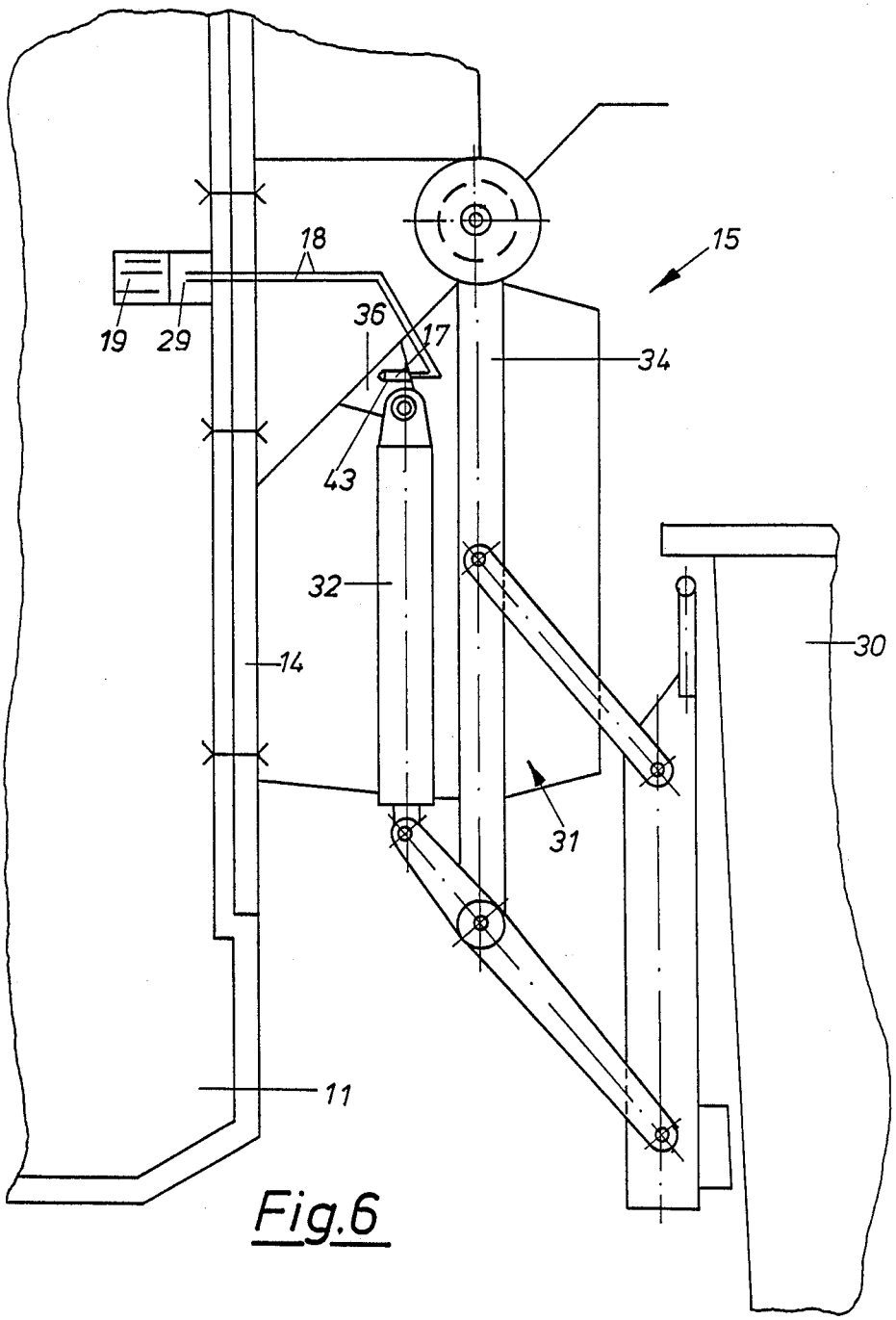
FIG. 6 is a side elevational view of the utility, constituting yet another embodiment of the invention.

In the example of FIG. 6, essentially the same design of the emptying utility 15 as in the example of FIGS. 4 and 5 is assumed. However, in this case a rod-shaped force transducer 17 is inserted into a hole 43 in the fixed mounting lug 36, by means of which the cylinder/piston unit is linked to the fixed intermediate frame 14. The rod-shaped force transducer 17 is so mounted in the fixed mounting lug 36 that it actively engages the power transmission path between the mounting of the cylinder/piston unit 32 and the intermediate frame 14.

Figure 7:
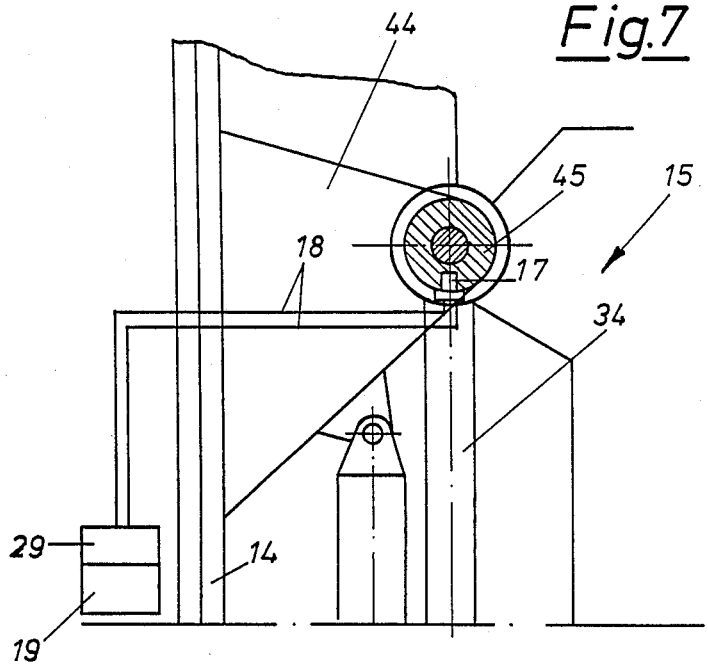
FIG. 7 is a detail partly in elevation and partly in vertical section, illustrating still another embodiment of the invention and showing the pivot shaft and its mounting.

In the example of FIG. 6, too, the force transducer 17 is connected by electrical lines 18 to the display 19 or to the latter's control and computer unit 29. In the example of FIG. 7, the pour-in utility 15 is again equipped with a pivot arm 34 which accepts the weight of the container to be emptied and whose pivot shaft 33 is mounted on a supporting plate 44 of the intermediate frame 14. Towards this end, a bearing assembly 45 for the pivot shaft 33 is firmly connected to the supporting plate 44. A force transducer 17 which, in this example, can be cam-shaped and act in an axial direction, is inserted in this bearing assembly vertically below the pivot shaft 33. Consequently, this force transducer 17 responds to the load transmitted from the pivot shaft 33 to the bearing assembly 45. In turn, this load depends upon the weight of the container received directly or indirectly by the pivot arms 34. The force transducer 17 thus transmits via the electrical lines 18 a signal to the indicating instrument 19 or its control and computing unit 29, having a magnitude depending upon the weight of the container attached to the pivot arms 34.

In the example according to FIG. 8 a basic design as in the example of FIG. 3 is assumed, i.e. the force transducer 17 is mounted in the cylinder lug 38 of the cylinder/piston assembly 32. The electrical lines 18 coming from the force transducer 17 are conducted in this example inside the control and computing unit 29 to an electrical low-pass filter 46 in which electrical oscillations as may be caused by mechanical vibrations occurring in the pour-in utility (15) are eliminated. The control and computing unit 29 is further equipped with a controller 47 connected to an electric switch provided on the pressure medium control device 48 of the cylinder/piston assemblage 32. Both the controller 47 and the electrical low-pass filter 46 are connected to the actual computer section 48 in which the level of the signal coming from the force transducer 17 is converted to units of weight in a calibrated manner.

With reference to FIG. 9 the operating mode is as follows:

By actuating the pressure medium controller 48, the cylinder/piston unit 32 starts to be acted upon, preferably hydraulically, at the intersection of the abscissa and ordinate of FIG. 9. Over the time span $t_1$ the lifting/tilting frame 35 (FIG. 4) moves towards the garbage pail 30; the signal appearing during this process corresponds to the weight of the lifting/tilting frame 35. As soon as the lifting/tilting frame 35 has gripped the container 30 to be emptied, a steep rise of the signal transmitted by the force transducer 17 to the control and computing unit 29 sets in, until it corresponds to the total weight of the lifting/tilting frame 35, the container 30 and the container contents. This higher signal prevails for the time $t_2$, during which the container 30 to be emptied is raised by the lifting/tilting frame 35 into the latter's uppermost position on the pivot arms 34. Then there occurs an upward swing of the totality of the lifting/tilting frame 35, the pivot arms 34 and the filled container 30. This requires a considerably greater amount of power, expressed by the second steep rise of the signal curve in FIG. 9. The maximum of the signal curve of FIG. 9 then corresponds to the state in which the container 30 is tilted into its emptying position, opens up and lets the container content drop out. This causes a reduction of the power requirement, noticeable by the drop of the curve in FIG. 9. Once the container 30 is emptied and after a time $t_3$ has elapsed, the pressure medium controller 48 is reversed and the cylinder/piston unit is relieved. The pivot arms 34 then swing back with the lifting/tilting frame 35 and the emptied container 30, as evidenced by the falling branch of the curve in FIG. 9. When the pivot arms 34 have reached their lowered positions, the lifting/tilting frame 35 with the attached and emptied container 30 is lowered during a time span $t_4$. During this time span $t_4$ there prevails a force-transducer-17 signal which corresponds to the weight of the lifting/tilting frame 35 and the emptied container 30. When the container 30 is then placed on the ground, the signal drops further. Its residual value still remaining then corresponds only to the weight of the lifting/tilting frame 35.

This course of the signal curve according to FIG. 9 can be used with the arrangement according to FIG. 8 and in interaction with the switch provided at the pressure medium controller 48 for the determination of the container weight or of the weight of the container content as follows:

At the intersection of the abscissa and ordinate, according to FIG. 9 the timer contained in the controller 47 is started, which then runs for a time period $t_5$. At the end of this time period $t_5$ the computer 48 is activated. This activation of the computer is maintained for a time period $t_6$, which thus forms a time-clock window. Within this time-clock window $t_6$ the applied signal for the determination of the weight of the lifting/tilting frame 35, container 30 and container content is evaluated and stored. With the reversal of the pressure medium controller 48 to pressure relief or swingback operation, another timer in the controller 47 is started which runs for a time period $t_7$ and is a second time-clock window $t_8$. During the time window $t_8$ the computer 48 is again activated in order to convert the applied signal into the weight of the lifting/tilting frame and the emptied container. This second measured value, or second converted weight value is deducted from the measured or weight value stemming from the clock window $t_6$ so that the resultant weight difference corresponds to the weight of the container content. This weight of the container content is fed to the indicating instrument 19 and to the registering instrument 49. What has to be taken into account in this evaluating procedure, however, is that two measured values or converted weight values laden with measuring errors are being deducted from each other so that a relatively big, relative (percentage) error must be expected. On the other hand, however, this evaluating mode offers the advantage that it is independent of the net weight of the container 30 to be emptied. If only containers 30 of the same net weight are to be emptied, the weight of the container content can be determined by the weight determination in the time-clock window $t_6$ alone in that the known net weight of the container and the known weight of the lifting/tilting frame are deducted from the weight value determined. Then a somewhat smaller relative error (percentage error) can be expected. The weight determination in the second time-clock window $t_8$ can also be used at the same time to check the control in both the first and second operating modes. For, if high weight is still found in the time clock window $t_8$, it can be concluded that the container 30 was not emptied completely. A comparison of the weight found in the time clock window $t_8$ with an expected weight of empty containers and lifting/tilting frames can then be used for the control of an immediately following emptying of the same container 30 if the difference between the weight determined and the weight to be expected exceeds a previously fixed value.

It is essential in all of the above-described operating modes that the weight determination in the time clock window $t_6$ takes place while the uninterrupted lifting operation is in progress, i.e. during the upward motion of the lifting/tilting frame 35 including the container 30 to be emptied, and the weight determination in the time clock window $t_8$ while the uninterrupted lowering operation is in progress, i.e. during the downward motion of the lifting/tilting frame 35 including the emptied container 30.

In the appended claims, the various structural features of the pour-in utility are sometimes referred to as "stressable members". This term is intended to include the support frame or fixed support 13, the intermediate frame 14, the lifting and tilting frame or mechanism 35, the arms that pivotally mount the frame 35 on the intermediate frame 13, and the cylinder/piston assemblage 32.

Applicants hereby claim priority under 35 USC 119, of German Application No. P 36 24 590.9 filed July 21, 1986.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

We claim:

1. Equipment for emptying containers, said equipment comprising in combination:
(a) a pour-in utility provided with a pour-in opening and with structural means, including stressable members, adapted to grasp, lift, return and off-load said containers,
(b) a force transducer which is carried by a member of said means and which is responsive to strain in the said member during the operation of said means,
(c) said pour-in utility further including indicator means having a control and computing unit,
(d) said indicator means being connected with said force transducer to receive signals therefrom, and having timing circuitry for selecting predetermined time interval windows during which readings from said force transducer are made,
(e) one of said time interval windows existing during the lifting of said containers by said structural means, and another of said time interval windows existing during the return of said containers, said indicator means automatically providing weight difference readings corresponding to the signals received from the force transducer during said other time interval window and said one time interval window,
(f) the said weight difference readings indicating the weight of the contents of the container which have been emptied therefrom and poured into the pour-in opening of the pour-in utility.

2. Equipment according to claim 1, and further including:
(a) a low-pass filter disposed between the force transducer and the said computer, for passing only low-frequency components of the signals generated by the force transducer.

3. Equipment according to claim 1, wherein said pour-in utility includes:
(a) a collecting tank (11),
(b) said structural means comprising a lifting-tilting mechanism for engagement with said containers,
(c) said structural means further comprising a fixed support (13) carried on said collecting tank,
(d) said structural means further including an intermediate frame (14) movably mounted on said fixed support and pivotally carrying said lifting-tilting mechanism,
(e) said force transducer means being mounted between said fixed support and said intermediate frame (14) to monitor relative movement therebetween resulting from weight applied to the lifting-tilting mechanism.

4. Equipment according to claim 3, and further including:
(a) additional force transducers mounted on said lifting-tilting mechanism, for providing measurement of relative movement between said lifting-tilting mechanism and the said intermediate frame.

5. Equipment according to claim 3, and further including:
(a) means including rubber-metal elements, for yieldably mounting said intermediate frame to said fixed support.

6. Equipment according to claim 3, wherein said pour-in utility includes:
(a) means comprising forked levers, for yieldably mounting said intermediate frame to said fixed support.

7. Equipment according to claim 6, wherein:
(a) said forked levers have mechanical attenuating and buffering elements acting between the intermediate frame and the fixed support.

8. Equipment according to claim 3, wherein:
(a) said structural means comprises means selectively locking the intermediate frame to the fixed support, so as to relieve the force transducer of stress when the equipment is not being used to handle containers.

9. Equipment according to claim 8, wherein:
(a) the said locking means is mechanically operable.

10. Equipment according to claim 1, wherein:
(a) said structural means comprises a lifting-tilting mechanism for engagement with said containers, and
(b) additional force transducers mounted on said lifting-tilting mechanism, providing for measurement of relative movement between it and other portions of the structural means.

11. Equipment according to claim 1, wherein said pour-in utility includes:
(a) a collecting tank,
(b) said structural means comprising a lifting-tilting mechanism for engagement with said containers,
(c) said structural means further comprising a fixed support (13) carried on said collecting tank,
(d) said force transducer being mounted between said fixed support and said lifting-tilting mechanism to monitor relative movement therebetween resulting from weight applied to the said mechanism.

12. Equipment according to claim 11, wherein:
(a) said structural means comprises a drive mechanism disposed between said fixed support and said tilting-lifting mechanism, and
(b) an additional force transducer located at said drive mechanism, for monitoring movement between the fixed support and the tilting-lifting mechanism.

13. Equipment according to claim 1, wherein said pour-in utility includes:
(a) a collecting tank,
(b) said structural means comprising a lifting-tilting mechanism for engagement with said containers,
(c) said structural means further comprising a fixed support,
(d) said structural means additionally comprising a cylinder/piston assemblage connected between said fixed support and said tilting-lifting mechanism, and
(e) an additional force transducer located at one end of said cylinder/piston assemblage and arranged to sense movement between the assemblage and the fixed support.

14. Equipment according to claim 13, and further including:
(a) a third force transducer located at the other end of said cylinder/piston assemblage and arrange to sense movement between said assemblage and the tilting-lifting mechanism.

15. Equipment according to claim 14, wherein:
(a) said cylinder/piston assemblage has a mounting lug at one end with a hole in it, (b) one of said force transducers being mounted in said hole.

16. Equipment according to claim 13, wherein:

(a) said cylinder/piston assemblage has a bearing connecting the assemblage to said fixed support, (b) said bearing having a hole in it, and (c) said additional force transducer being mounted in said hole.

17. Equipment according to claim 1, wherein said pour-in utility includes:

(a) a collecting tank, (b) said structural means comprising a lifting-tilting mechanism for engagement with said containers, (c) said structural means further comprising a fixed support and an intermediate frame disposed between said fixed support and said tilting-lifting mechanism, (d) said force transducer being carried by said fixed support and in turn supporting said intermediate frame.

18. Equipment for emptying containers, said equipment comprising, in combination a pour-in utility which is provided with a pour-in opening and provided with a lifting-tilting mechanism that is carried on a fixed support located at the said pour-in opening of the equipment, and that is provided with fittings engageable with the containers to be emptied as well as drive means for said lifting-tilting mechanism, said drive means being carried by said fixed support, characterized in that force transducer means are provided, carried on the pour-in utility, for monitoring the weight of portions of the lifting-tilting mechanism beginning with the lifting of a container by the lifting-tilting mechanism, through a lifting stroke time interval wherein the container is lifted substantially vertically, and through a return, down-stroke interval after the contents of the container have been emptied into the pour-in opening of the pour-in utility, and further characterized in that there is a computer and indicator on the pour-in utility, said computer having timing means for selection of a predetermined time-interval window located in said lifting stroke interval, and a second predetermined time-interval window in said return down-stroke interval, said computer having means for subtracting the weights measured by the force transducer during said first and second time interval windows to thereby provide a difference reading corresponding to the weight of the contents that have been transferred from the container to the said pour-in opening of the pour-in utility.

* * * * *